US006315075B1

(12) United States Patent
Nakajima

(10) Patent No.: US 6,315,075 B1
(45) Date of Patent: Nov. 13, 2001

(54) BOREHOLE LOGGING TOOL WITH ANCHORING MECHANISM

(75) Inventor: Hiroshi Nakajima, Kanagawa-ken (JP)

(73) Assignee: Schlumberger Technology Corporation

( * ) Notice: Subject to any disclaimer, the term of this patent is extended or adjusted under 35 U.S.C. 154(b) by 0 days.

(21) Appl. No.: 09/508,586

(22) PCT Filed: May 29, 1998

(86) PCT No.: PCT/IB98/00832

§ 371 Date: Mar. 8, 2000

§ 102(e) Date: Mar. 8, 2000

(87) PCT Pub. No.: WO99/63197

PCT Pub. Date: Dec. 9, 1999

(51) Int. Cl.[7] ..... G01V 1/40

(52) U.S. Cl. ..... 181/102; 181/105; 181/112; 181/122; 175/81; 175/83; 175/230; 367/35; 166/382; 166/206

(58) Field of Search ..... 181/102, 105, 181/111, 112, 122, 139; 175/76, 81, 82, 83, 98, 230; 367/25, 35, 82, 86; 166/382, 206, 118, 98

(56) References Cited

U.S. PATENT DOCUMENTS 4,130,816 * 12/1978 Vogel et al. ..... 340/15.5 BH
4,184,546 * 1/1980 Nicolas et al. ..... 166/206
4,616,703 * 10/1986 Laurent et al. ..... 166/66.4
4,819,760 * 4/1989 Petermann ..... 181/102
5,528,556 * 6/1996 Seeman et al. ..... 367/25
5,829,531 * 11/1998 Hebert et al. ..... 166/382

* cited by examiner

*Primary Examiner*—Robert E. Nappi
*Assistant Examiner*—Edgardo San Martin
(74) *Attorney, Agent, or Firm*—Steven L. Christian

(57) ABSTRACT

A borehole tool, such as a seismic shuttle-type logging tool, including a tool body having at least one sensor package and an anchoring mechanism, the anchoring mechanism having a drive mechanism including a motor, a drive shaft and a clutch; an anchoring arm moveable between first (extended) and second (retracted) positions relative to the tool body; a push rod connecting the anchoring arm to the drive mechanism; and a spring acting to bias the arm into a first position relative to the tool body. The push rod extends through the clutch mechanism and is engaged by the spring to bias the arm into the first position, and is also driven by the drive mechanism through the clutch to move the arm between the first and second positions. The spring is a coil spring surrounding the drive mechanism and acting on the push rod directly.

16 Claims, 5 Drawing Sheets

BOREHOLE LOGGING TOOL WITH ANCHORING MECHANISM

TECHNICAL FIELD

The present invention relates to borehole logging tools, and in particular to aspects of an actuating mechanism for a seismic shuttle logging tool in which a sensor package is urged against the wall of a borehole.

BACKGROUND ART

Seismic shuttle logging tools are know for use in performing vertical seismic profile surveys from boreholes to evaluate the surrounding underground formations. A multi-shuttle seismic tool comprises a number of similar tools (shuttles) linked together by means of a cable and logged through a borehole while seismic signals are generated at the surface. At each measurement level, each shuttle is anchored to the wall of a borehole during a measurement operation by means of an anchoring arm. In VSP surveys, it is necessary to make measurements at a number of levels in a borehole so the tool anchoring must be released to allow the tool to be moved and then re-engaged at the next level. The time taken for the anchor to release and to re-engage can be a significant factor in the time taken to make a measurement at each level. In Schlumberger's Combinable Seismic Imager tool (CSI) the anchoring arm of each shuttle extended under spring bias and a drive motor is used to provide the anchoring force or retraction. Aspects of the CSI are described in U.S. Pat. No. 4,563,757; U.S. Pat. No. 4,575,831; U.S. Pat. No. 4,987,969; and U.S. Pat. No. 5,200,581. In particular, patents '757 and '831 relate in particular to the anchoring mechanism and procedure. A schematic figure from the patents is shown in FIG. 1. This prior art arrangement includes a motor 35, an output reducer 36 with an electromagnetic brake 37 and an output shaft to a coupling device 39 comprising a clutch 50, a mechanical logic 51 and torque limiter 54. The mechanical logic 51 includes studs located in helical, V-shaped, cam slots which serve to bring the clutch into engagement on operation of the motor. Drive is transmitted to a push rod 34 connected to the anchoring arms 31, 32 by means of a ball screw 40 and nut 41. The anchoring arms are urged away from the tool body 29 by a leaf spring 43 which is fixed to the tool body 29 and bears upon the arm 31. When in the open position, a pad 30 at the end of the arms 31, 32 engages the borehole wall and causes the tool body 29 to be pushed against the opposite side of the borehole where it can be anchored for use. The motor 35 is used to provide the extra anchoring force to the arms 31,32 and to withdraw the arms when the tool is run in or pulled out of the borehole. When the tool is to be moved to a different level, the action of the clutch 50 allows the motor to be disengaged and the arms held only by the force of the leaf spring 43.

The present invention has as its object a tool which has an anchoring arm which can be anchored and released in a relatively short time and in which the anchoring mechanism can be relatively compact.

DISCLOSURE OF INVENTION

The present invention provides a borehole tool comprising a tool body having at least one sensor package and an anchoring mechanism, the anchoring mechanism comprising:

a) a drive mechanism including a motor, a drive shaft and a clutch;

b) an anchoring arm moveable between first and second positions relative to the tool body;

c) a push rod connecting the anchoring arm to the drive mechanism; and d) a spring acting to bias the arm into a first position relative to the tool body;

characterised in that the push rod extends through the clutch mechanism and is engaged by the spring to bias the arm into the first position, and is also driven by the drive mechanism through the clutch to move the arm between the first and second positions.

The invention is particularly applicable to shuttle-type seismic borehole logging tools although may also be applicable to any other type of borehole tool which requires the tool body to be urged against the borehole wall. The provision of the push rod extending through the clutch mechanism allows the overall length of the anchoring mechanism to be reduced over that provided by the prior art device. The sensor package can be a separate package with one or more sensors mounted on the tool body or one or more sensors and associated electronics mounted in the tool body.

It is particularly preferred that a ball-bearing clutch is used which comprises a collar having a number of balls which engage in grooves in the push rod to allow the drive mechanism to move the arm. A spring loaded retaining ring can be provided to hold the balls in a driving position in the grooves when engaged by the collar.

The drive shaft is typically a drive screw and a nut is used to transmit the driving force to the push rod. Driving force can be applied either through the clutch or by bearing surfaces on the nut which engage directly extensions of the push rod. The two mechanisms can be used to provide reversible drive to the push rod.

The spring can be a coil spring which is located in the tool body around the drive mechanism. Other arrangements of springs or resilient biasing means can be used to urge the arm into the first position.

The arm can be mounted on a pivot on the tool body with the first position being extending away from the tool body and the second position being along the tool body. Thus, the spring can be used to urge the arm away from the tool body and the motor used to provide further drive in this direction for anchoring force, or to provide a counteracting drive to withdraw the arm to the tool body. By reversing the drive to release the clutch, the arm can be held under spring force alone while the tool is moved in the borehole.

An arm position sensor can be used to indicate the exact position of the arm after movement.

BEST MODE FOR CARRYING OUT THE INVENTION

Figure 1:
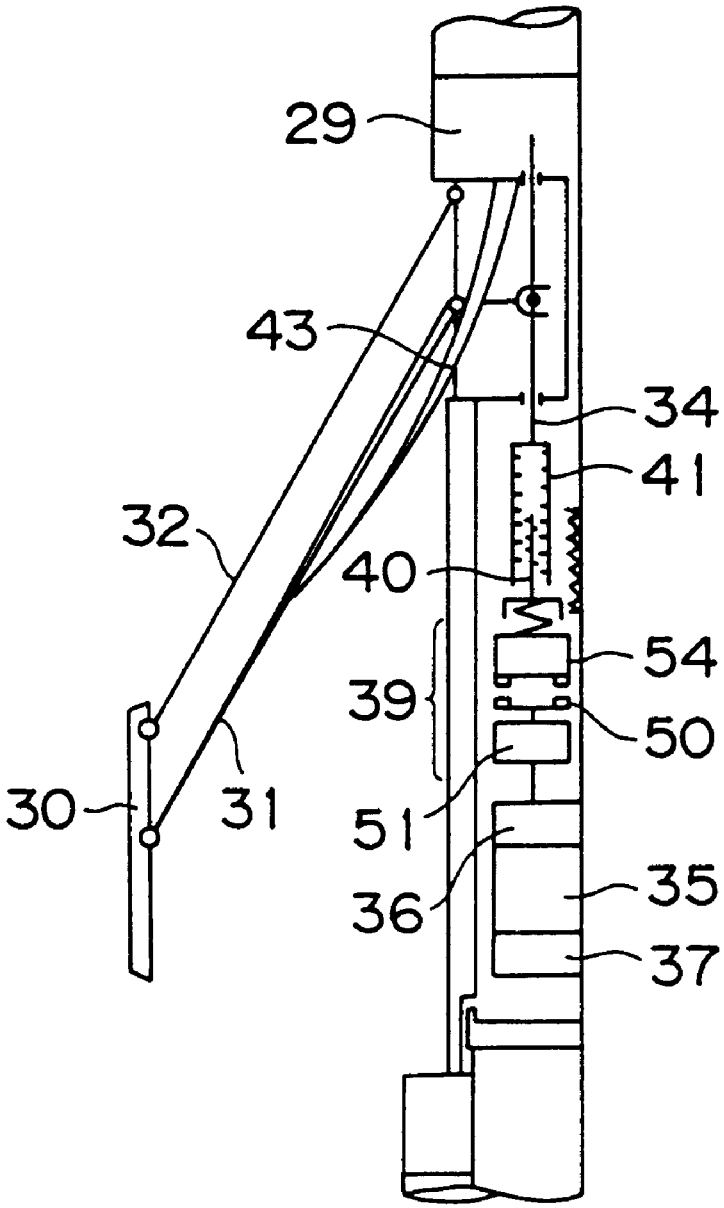
FIG. 1 PRIOR ART
FIG. 1 shows a schematic view of a prior art tool.
Figure 2:
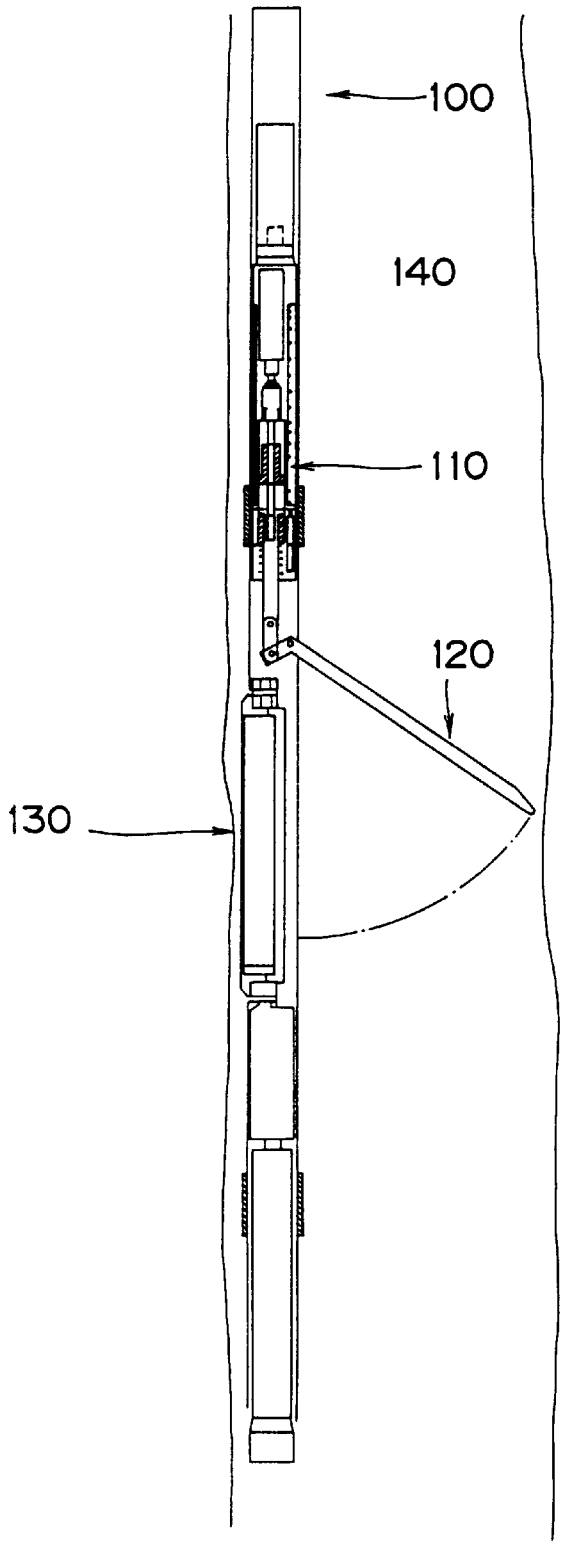
FIG. 2 shows a schematic view of a shuttle seismic logging tool incorporating the present invention.

The present invention finds particular application in multi-shuttle seismic logging tools. Such tools are used in VSP surveys and comprise a number of identical or similar shuttles connected in end-to-end fashion by cable. A single shuttle is shown in FIG. 2 which comprises a tool body 100, an anchoring mechanism 110 including an anchoring arm 120 and a sensor package 130. In use, a number of these shuttles, from 2 to 20, typically 4 to 8, are connected together and logged through the borehole 140.

Figure 3:
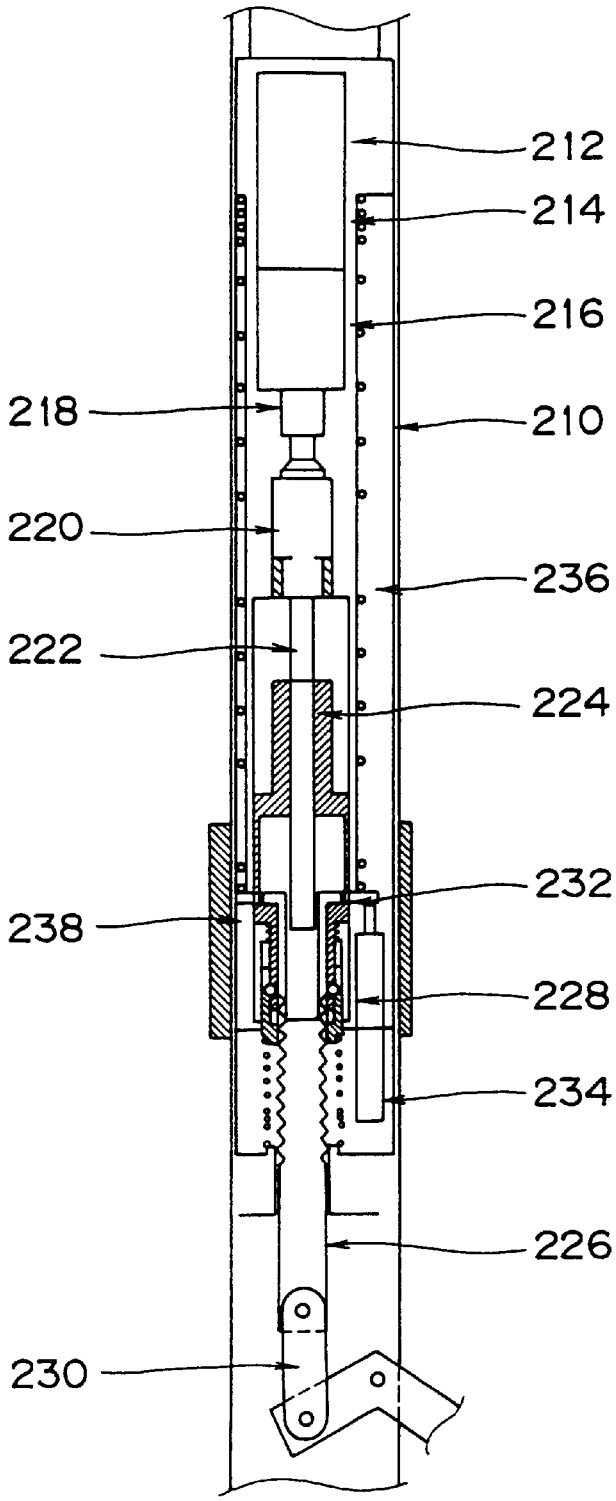
FIG. 3 shows a detailed view of a part of the shuttle shown in FIG. 2.

FIG. 3 shows a detailed view of the anchoring mechanism 110. The mechanism includes a permanent magnet (or electromagnet) brake 212, motor 214 and reducer arrangement 216 housed in the shuttle body 210. The output drive from the reducer 216 connects through a joint 218 and bearing 220 to a ball screw 222. The ball screw 222 drives a nut 224. The end of the screw 222 projects into the hollow end of a push rod 226 and the end of the nut 224 engages the outer surface of the push rod 226 through a clutch mechanism 228 which is described in more detail below. The end of the push rod 226 is connected to a link 230 through which it drives the anchoring arm of the shuttle (120 in FIG. 2). The inner end of the push rod 226 is formed into a base section 232 which fits inside the nut 224. The base section 232 also has extensions outside the nut 224 to provide a connection to a potentiometer (or a linear variable differential transformer "LVDT") 234 which acts as position sensor for the push rod 226 and so can be used for a calliper measurement in the borehole using the anchoring arm. A compression spring 236 is located around the motor/ball screw mechanism inside the shuttle body and acts on the base section 232 so as to normally urge the push rod 226 and hence the arm, outwards. The extension of the push rod 226 under by the spring 236 is limited by the position of the nut 224 on the screw 222 such that operating the motor 214 to move the nut 224 causes the push rod 226 to move out due to the spring 236 or be pulled in by the action of the nut 224.

Figures 4A, 4B, 4C, 4D:
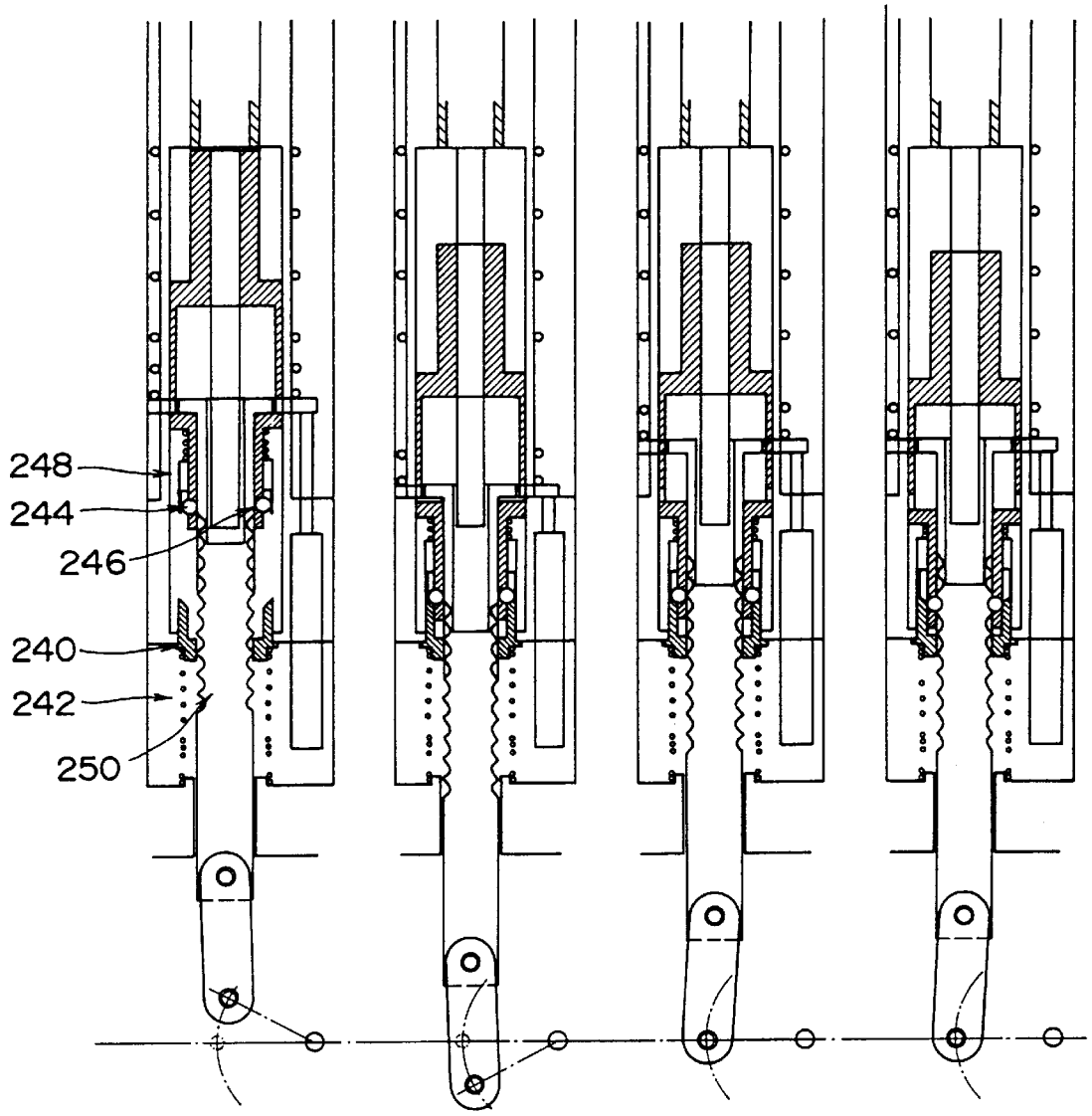
FIGS. 4 *a–d* show the positions of the parts of the actuating mechanism of the shuttle of FIG. 3 during various stages of deployment.

Extension of the push rod 226 by the spring 236 is limited by either the arm contacting the borehole wall (FIG. 4*c*) or by the base section 232 reaching the stops 238 positioned in the body (fully extended) (FIG. 4*b*). Once the arm contacts the borehole wall, the nut 224 moves over the push rod 226 to activate the clutch 228 such that the screw 222 and nut 224 drives the push rod 226 directly and forces it against the borehole wall to anchor the shuttle (FIG. 4*c*).

To release the arm, the motor is reversed and the screw 222 retracts the nut 224, releasing the clutch 228. The arm is then only held against the borehole wall by the spring 236 and so can move in or out as the shuttle is moved to a different position in the well. It is not necessary to retract the arm completely. If it is desired to retract the arm completely, the reverse motor drive is continued and the nut 224 is retracted along the screw 222 until it contacts the base section 232 of the push rod 226 which it then pulls back against the action of the spring 236 to retract the push rod 226 and thus the anchor arm. When the arm is fully retracted, the motor stalls and this is detected to find the fully retracted/closed position of the arm. The output from the potentiometer 234 can also be used to detect the arm in its fully retracted position.

The clutch mechanism 228 (shown in more detail in FIG. 4*a*) is formed by the outer end of the nut 224 through which the push rod 226 projects, and a collar 240 located in the shuttle body 210 around the push rod 226 by a spring 242. The outer end of the nut has a number of seats 244 each having a ball bearing 246 located inside. A retaining ring 248 prevents the balls 246 from falling out of the seats 244. A number of grooves 250 are formed in the outer surface of the push rod 226. As the end of the nut moves over the push rod 226 after it has contacted the wall of the borehole, the balls 246 are free to move in and out of the grooves 250 without inhibiting movement of the nut 224, until the outer end of the nut 224 contacts the collar 240 (FIG. 4*c*). At this point, once the balls 246 drop into the next groove 250, the collar is allowed to move over the seats and prevent the balls 246 from moving out of the groove 250. Further motion of the nut 224 is transmitted to the push rod 226 by the balls 246 engaged in the groove 250 to provide the anchoring force for the arm (FIG. 4*d*). Reversing the motor drive retracts the nut 224 from the collar 240 so allowing the balls to move out of the groove 250 and permit the push rod to move back against the spring 236. The motion of the nut required to activate the clutch between first contacting the collar 240 and driving or releasing the push rod 226 is small, for example in the order of 3 mm. Thus the time to lock and unlock the arm is small and has less impact on the time taken to move the shuttle between measurement locations.

In this arrangement, all of the drive mechanism and springs are located within the shuttle body with only simple mechanical linkages exposed. This is to be contrasted with the prior art mechanism which has the leaf spring outside the tool. Also, eliminating the clutch and engagement mechanism between the motor and the screw and implementing the clutch between the nut and the push rod in the manner described above allows a shorter overall length.

Figure 5:
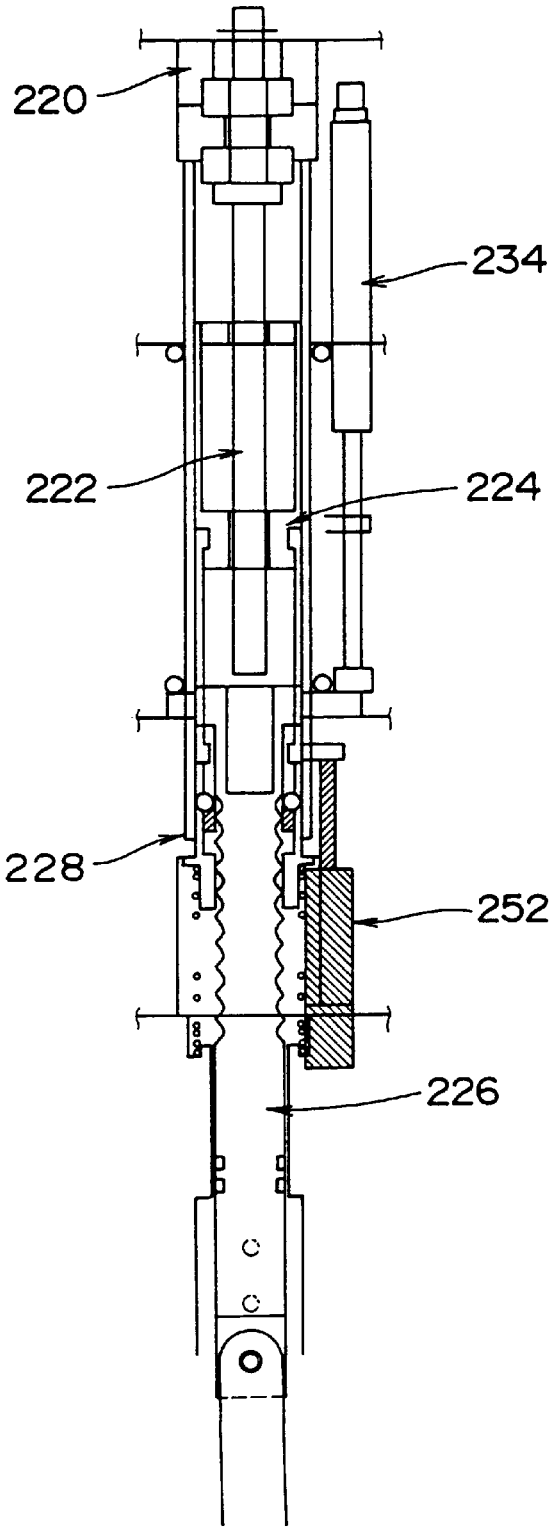
FIG. 5 shows a partial view of another embodiment of the mechanism.

An alternative embodiment is shown in FIG. 5 which has parts omitted for clarity. In this case, the potentiometer or LVDT 234 lies alongside the ball screw 222. A position switch 252 is located alongside the push rod 226 and clutch 228 to detect whether or not the clutch is engaged. This information is used in operation of the mechanism to actuate the tool.

Industrial Applicability

The present invention finds application in the field of borehole logging tools, particularly seismic multi-shuttle logging tools which can be used to evaluate the formations surrounding boreholes such as are drilled for the extraction of hydrocarbons or geothermal energy.

What is claimed is:

1. A borehole tool comprising a tool body having at least one sensor package and an anchoring mechanism, the anchoring mechanism comprising:

a) a drive mechanism including a motor, a drive shaft and a clutch mechanism;

b) an anchoring arm moveable between first and second positions relative to the tool body; and c) a push rod extending through the clutch mechanism connecting the anchoring arm to the drive mechanism, the push rod engaging a spring which acts to bias the arm into the first position, and driveably connecting the drive mechanism through the clutch such that the arm can be moved between the first and second positions.

2. A tool as claimed in claim 1, wherein the clutch mechanism comprises a collar having a number of balls which engage grooves in the push rod to allow the drive mechanism to move the arm.

3. A tool as claimed in claim 2, wherein the clutch mechanism includes a spring-loaded retaining ring which causes the balls to be held in a driving position in the grooves when engaged by the collar.

4. A tool as claimed in claim 1, wherein the drive shaft comprises a drive screw which acts on the clutch mechanism by means of a nut to transmit drive to the push rod.

5. A tool as claimed in claim 4, wherein the nut is provided with surfaces which engage extensions of the push rod to allow the drive mechanism to act on the push rod to move the arm to the second position.

6. A tool as claimed in claim 1, wherein the spring comprises a coil spring surrounding at least part of the drive mechanism.

7. A tool as claimed in claim 1, wherein the drive mechanism, push rod and spring are all located within the tool body.

8. A tool as claimed in claim 1, wherein the first position of the arm has the arm extending away from the tool body so as to engage a wall of a borehole in which the tool is positioned, and the second position of the arm has the arm lying close to the tool body.

9. A tool as claimed in claim 8, wherein the drive mechanism is used to control the movement of the arm under the influence of the spring between the first and second positions, and can also act to further urge the arm to the first position so as to apply force to the borehole wall.

10. A tool as claimed in claim 9, wherein the spring and the drive mechanism operate so as to cause the arm to engage the borehole wall and force the tool body against the opposite side of the borehole wall, the drive mechanism serving to provide extra force to anchor the tool body against the borehole wall while measurements are made using the sensor package.

11. A tool as claimed in claim 9, wherein the drive mechanism can be reversed to disengage the clutch mechanism and remove the extra force from the arm such that it only engages the borehole wall under the influence of the spring.

12. A tool as claimed in claim 10, wherein the drive mechanism can be reversed to disengage the clutch mechanism and remove the extra force from the arm such that it only engages the borehole wall under the influence of the spring.

13. A tool as claimed in claim 1, further comprising an arm position sensor.

14. A tool as claimed in claim 13, wherein the sensor is a potentiometer.

15. A tool as claimed in claim 1, wherein the arm is mounted on a pivot on the tool body, the push rod engaging an extension of the arm through a link.

16. A tool as claimed in claim 1, further comprising a position sensor for indicating the state of the clutch mechanism.

* * * * *